US008500368B1

(12) United States Patent
Deshazer et al.

(10) Patent No.: US 8,500,368 B1
(45) Date of Patent: Aug. 6, 2013

(54) UNDERPINNING PILE ASSEMBLY AND PROCESS FOR INSTALLING SUCH PILE ASSEMBLY

(75) Inventors: Henry L. Deshazer, Houston, TX (US); Michael W. Orchard, Houston, TX (US)

(73) Assignee: Patents of Tomball, LLC, Houston, TX (US)

( * ) Notice: Subject to any disclaimer, the term of this patent is extended or adjusted under 35 U.S.C. 154(b) by 171 days.

(21) Appl. No.: 13/029,893

(22) Filed: Feb. 17, 2011

(51) Int. Cl.
*E02D 5/22* (2006.01)

(52) U.S. Cl.
USPC ..... 405/230; 405/231; 405/232

(58) Field of Classification Search
USPC ..... 405/230, 231, 232
See application file for complete search history.

(56) References Cited

U.S. PATENT DOCUMENTS

| | | | | |
|---|---|---|---|---|
| 5,288,175 | A | 2/1994 | Knight | |
| 5,399,055 | A | 3/1995 | Dutton, Jr. | |
| 5,713,701 | A | 2/1998 | Marshall | |
| 6,179,526 | B1 | 1/2001 | Knight et al. | |
| 6,200,070 | B1 | 3/2001 | Knight | |
| 6,543,967 | B1 | 4/2003 | Marshall | |
| 6,634,830 | B1 | 10/2003 | Marshall | |
| 6,718,648 | B1 | 4/2004 | Knight | |
| 6,722,820 | B2 | 4/2004 | Marshall | |
| 6,763,636 | B2 | 7/2004 | Dimitrijevic | |
| 6,799,924 | B1 | 10/2004 | Knight et al. | |
| 6,881,012 | B2 | 4/2005 | Covington | |
| 6,951,437 | B2 | 10/2005 | Hall | |
| 7,108,458 | B1 | 9/2006 | Davie, Jr. et al. | |
| 7,195,426 | B2 | 3/2007 | May | |
| 7,429,149 | B2 | 9/2008 | Price et al. | |
| 7,857,549 | B1 * | 12/2010 | Deshazer | 405/250 |
| 2005/0019103 | A1 * | 1/2005 | Brooks et al. | 405/230 |
| 2006/0067794 | A1 * | 3/2006 | Mitchell | 405/230 |
| 2008/0317556 | A1 | 12/2008 | Price | |
| 2010/0021242 | A1 * | 1/2010 | Dimitrijevic | 405/230 |

* cited by examiner

*Primary Examiner* — Benjamin Fiorello
(74) *Attorney, Agent, or Firm* — Egbert Law Offices, PLLC

(57) ABSTRACT

An underpinning pile assembly for supporting a structure upon the earth has at least one steel pipe with an interior passageway, a concrete pile segment positioned above the steel pipe, and a cable extending through an interior passageway of the steel pipe and through the interior passageway of the concrete pile segment. A locking assembly is connected to the cable and affixed within the steel pipe. This locking assembly includes a collar having an outer surface affixed to an interior wall of the lowermost pipe. The cable is affixed within an interior of the collar. A pair of wedges secure the cable within the interior of the collar.

11 Claims, 2 Drawing Sheets

UNDERPINNING PILE ASSEMBLY AND PROCESS FOR INSTALLING SUCH PILE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the repair of building foundations by underpinning. Additionally, the present invention relates to underpinning pile assemblies having both concrete piles and steel pipes.

2. Description of Related Art Including Information Disclosed Under 37 CFR 1.97 and 37 CFR 1.98.

There is a type of precast concrete pile used in the underpinning of building foundations comprised of vertically stacked, unconnected, precast concrete segments. These segments are pressed or driven vertically into the soil one at a time until adequate load capacity is obtained. This type of pile is distinctive in that it can be installed with almost no clearance, usually beneath an existing structure.

Although serviceable, this pile has several significant disadvantages: (a) the pile segments are not aligned, other than being stacked on each other, and detrimental misalignments can occur, (b) independent inspection of the installed pile depth is only possible by providing full-time inspection personnel during installation to monitor the quantity of pile segments used at each pile location, and (c) the complete pile is an unreinforced stack of precast concrete segments.

Misalignment of the segments as they are installed can produce several conditions detrimental to the future pile stability. Lack of proper independent inspection of pile depth can lead to inadequate pile penetration, which in highly expansive soils produces an unstable installation subject to continued movements caused by seasonal change in soil moisture content. An unreinforced or non-continuously reinforced pile is subject to permanent separation at segment joints or breakage at segment midpoints when installed in clay soils having high shrink-swell potentials.

In the past, various patents have issued relating to the devices for installing underpinning piles retroactively for the support of a structure. For example, U.S. Pat. No. 5,288,175, issued on Feb. 22, 1994 to D. W. Knight, describes a continuously reinforced segmental precast concrete underpinning pile. A method of installing the underpinning pile is used where a high-strength strand aligns the precast segments during installation. The strand provides a means for measurement of the pile penetration depth. The strand continuously reinforces the pile when bonded or anchored upon completion. This patent describes a further process whereby a strand is affixed to a first pile segment prior to being driven into the earth. The first pile segment, along with the attached strand, is driven a desired distance into the earth from the supporting structure. The strand will extend upwardly and outwardly from an end of the first pile segment. The second pile segment then slides along the strand until the second pile segment contacts an end of the first pile segment. The second pile segment is then driven into the earth for a desired distance. Ultimately, after each of the pile segments is driven a desired distance into the earth, a cap member is affixed to the top of the array of pile segments so as to be placed under the foundation of the structure. In "chicken pot pie" type soil conditions, where a softer layer of earth is located between a stiff crust and a denser, lower layer, the method of this patent fails to utilize existing pile structures. As such, there is a considerable cost associated with the driving of multiple pile segments through the softer layer of the earth. With such soil structures, it would be desirable to use the existing pile structures if possible.

U.S. Pat. No. 5,399,055, issued on Mar. 25, 1995 to E. T. Dutton, Jr., teaches a device and method to level and repair a failed concrete foundation. A series of cylindrical pile segments are jacked into the soil to a pre-determined depth so as to attain sufficient skin friction. Water jetting is utilized during the jacking process to loosen and remove soil. Reinforcing steel is inserted into the stacked column of cylindrical pile segments and grout is further pumped into the cylindrical pile segments to suitably fix the reinforcing steel to the inside of the cylindrical piles. This forms a single shaft pile so as to eliminate or reduce pile deflection and shear. Once again, the patent fails to make use of existing timber piles.

U.S. Pat. No. 5,713,701, issued on Feb. 3, 1998 to F. S. Marshall, describes a foundation piling which has a metallic piling sleeve member filled with solidified or cured cementitious material and a hollow, cylindrical outer sleeve member having a diameter larger than that of the metallic sleeve member. The outer sleeve member is placed generally concentrically around the piling sleeve member. The piling and the outer sleeve member are vertically driven into the soil. Further metallic piling sleeves and outer sleeve members are successively vertically driven into the soil until the piling is complete and the metallic piling sleeve and outer sleeve members abut one another in vertical relation.

U.S. Pat. No. 6,179,526, issued on Jan. 30, 2001 to Knight et al., shows a method of forming a pile isolation void. This method includes the steps of forming a foundation pile having an enlarged cross-section within a specific localized section, and driving the foundation pile a desired distance into the earth so as to form a pile isolation void directly above the enlarged cross-section. The enlarged cross-section can be located at the bottom of the foundation pile or along the length of the foundation pile. The pile isolation void is an annular void extending around the foundation pile above the enlarged cross-section. This pile isolation void can be filled with a material, such as liquid, gel, or a solid material different than the material of the pile or of the earth.

U.S. Pat. No. 6,200,070, issued on Mar. 13, 2001 to D. W. Knight, shows process of installing piles for supporting a structure upon the earth. This process includes the steps of forming a receptacle in a first pile segment, affixing an end of a strand into the receptacle such that the strand extends outwardly from the first pile segment, sliding a second pile segment onto the strand until the second pile segment contacts a surface of the first pile segment, and driving the second pile segment a desired distance into the earth. The receptacle is formed in the first pile segment while the first pile segment is in the earth.

U.S. Pat. No. 6,543,967, issued on Apr. 8, 2003 to F. S. Marshall, shows a staggered rebar design for concrete pilings. A first pile segment is driven into the earth. Two support rods of varying length are positioned and grouted into a passage running through the segment. The first support rod is one-half of the height of the pile segment, while the second is one and one-half times the height of the pile segment. An additional pile segment is driven on top of the first segment. Support rods which are twice the height of a single segment are positioned and grouted into the passage.

U.S. Pat. No. 6,634,830, issued on Oct. 21, 2003 to F. S. Marshall, describes a method and apparatus for post-tensioning segmented concrete pilings. A cable anchor serves as a base segment for multiple concrete piling segments. After installing all the concrete segments on top of the base segment, a cable is inserted into passages in the segments. The cable is threaded through the completely installed piling segments and into the cable anchor. After the cable bottoms out in the cable anchor, upward tension is applied to the cable. As the cable is pulled, cable lock members in the cable anchor increase gripping pressure as the cable tension increases so as to solidly anchor the end of the cable in the cable anchor.

U.S. Pat. No. 6,718,648, issued on Apr. 13, 2004 to T. S. Knight, shows a method of measuring a length of a pile which supports a structure upon the earth. This method includes the steps of affixing a flexible strand to a first pile segment, driving the first pile segment a desired distance into the earth such that the flexible strand extends along the length of the first pile segment along an exterior surface thereof, and driving a plurality of additional pile segments into the earth such that the pile segments reside upon an end of the first pile segment. The flexible strand extends along a length of the plurality of additional pile segments on the exterior surface thereof.

U.S. Pat. No. 6,722,820, issued on Apr. 20, 2004 to F. S. Marshall, provides a method of installing grout within a piling. Pile segments are driven into the ground on top of each other so as to form a piling. A single piling passageway is formed when the pile segments are in alignment. An alignment securing assembly is placed in the passageway. Vibrations are sent through the piling so that grout will not gather in the upper portions of the passageway before the lower portions of the passageway are filled with grout. The alignment securing assembly uses an anchoring device that is lowered and set in the passageway so that tension can be applied by a cable.

U.S. Pat. No. 6,763,636, issued on Jul. 20, 2004 to M. Dimitrijevic, provides a method and apparatus for lifting and leveling an existing building. At least a first non-cylindrical support section and a second support section are coupled together by a fastening device. A jack is used to raise the foundation of the existing building to a desired height. The apparatus is attached to the foundation of the building from underneath the building or from a location adjacent a side of the building.

U.S. Pat. No. 6,799,924, issued on Oct. 5, 2004 to Knight et al., describes a segmented concrete piling assembly with steel connecting rods. A first starter pile segment is driven into the soil adjacent the structure. A connecting rod is inserted into the upper end of the starter pile segment. A second or follower pile segment is placed on the upper end of the starter pile segment, over the connecting rod, and driven into the soil. This further drives the starter pile segment into the soil.

U.S. Pat. No. 6,881,012, issued on Apr. 19, 2005 to G. R. Covington, teaches a foundation repair system and method of installation. This system has continuously interlocked segmental precast concrete underpinning piles. A cooperating extension on one segment engages a cooperating depression on an adjacent segment. This aligns the precast segments during installation so as to provide a laterally stable pile.

U.S. Pat. No. 6,951,437, issued on Oct. 4, 2005 to D. B. Hall, provides a building foundation support and repair system. The system has a column of generally cylindrical pile sections driven into the earth below the edge of the foundation, and has an earth-penetrating bit attached to the lowermost pile section. The earth-penetrating bit includes a center post member extending within a bore in the lowermost pile section and/or a sidewall journaling the lower end of the lowermost pile section. The bit is connected to an elongated rod extending through the series of connected pile segments and is used to drive the bit rotatably during installation of the pile sections. This minimizes lateral excursion of the support system during and after installation of the column of pile sections.

U.S. Pat. No. 7,108,458, issued on Sep. 19, 2006 to Davie, Jr. et al., discloses a method and apparatus for repairing building foundations by segmented underpinning. In particular, there are a plurality of pile segments that are reinforced in a longitudinal direction. A precast starter segment has a coil embedded in one end of the segment and a coil rod protruding from the other end. The starter segment is driven into the earth with its protruding rod end facing downwardly. A second segment is interlocked with the first by threading the second segment's rod and into the coil of the starter segment. The second segment is screwed into the first segment until the two segments lock together.

U.S. Pat. No. 7,195,426, issued on Mar. 27, 2007 to D. May, provides a structural pier and method for installing the pier. The pier includes a pier shaft, a bracket mounted to a top end of the pier shaft that supports the weight of the foundation, and a pair of braces that extend laterally from the pier shaft and mount to the foundation.

U.S. Pat. No. 7,429,149, issued on Sep. 30, 2008 to Price et al., provides a sleeved, segmented support product for supporting a foundation. This product comprises support segments that can be assembled together into a variable-length pile. The segments assemble together telescopically so that adjacent segments are held in coaxial relation and resist radial misalignment that can reduce the load-bearing capacity of the support product.

U.S. Patent Publication No. 2008/0317556, published on Dec. 25, 2008 to M. Price, describes a pier system for supporting a building. The pier system includes a plurality of swaged pier segments in which each swaged pier segment is operable to be connected to another of the swaged pier segment. A hinged lifting platform is secured to an uppermost one of the swaged pier segments. At least one intermediate swaged pier segment is connected to the uppermost swaged pier segment. An encasement is provided for partial receipt of the intermediate swaged pier segment.

U.S. patent application Ser. No. 12/429,914, filed on Apr. 24, 2009, to one of the present inventors, describes an underpinning pile assembly for supporting a structure upon the earth and a process for installing such underpinning pile assembly. This underpinning pile assembly includes at least one steel pipe, at least one concrete pile segment positioned above the steel pipe, and a transition member interposed between the steel pipe and the concrete pile segment such that the load of the concrete pile segments is supported by the steel pipe. The plurality of steel pipes extend in end-to-end relationship in generally vertical alignment. A first steel pipe segment and a second steel pipe segment are engaged together through the use of a key member. Each of the first steel pipe segment and the second steel pipe segment have slots formed at ends thereof. The key member is received in these slots. The transition member is a collar which receives the steel pipe therein and a flange affixed to the end of the collar. The plurality of concrete pile segments has a hole extending longitudinally therethrough and a strand affixed in the holes of these pile segments. An adhesive is received in the holes of the pile segments so as to fix the strand into each of the pile segments. This application also describes a process of installing piles that includes the steps of driving a steel pipe into the earth a desired distance from the structure, positioning a concrete pile upon an end of the steel pipe, and driving the steel pipe segment into the earth a desired distance from the structure so as to correspondingly drive the steel pipe further into the earth.

One of the problems associated with these prior art underpinning pile assemblies is the use of concrete pile segments. In certain earth formations, it becomes very difficult to drive these pile segments the proper and desired distance into the earth. In particular, when the earth is particularly hard or dense, great forces would be required so as to cause the pile segments to reach their intended depth. As such, it would be desirable to provide an underpinning pile assembly which allows the underpinning piles to reach the proper and desired depth in a simple, convenient and efficient manner.

In those prior art patents that utilize steel sleeves or other steel systems, the steel members are generally positioned adjacent to the building foundation. As such, the steel members are driven into the earth in an area that is exposed to oxygen and moisture. Over time, these steel members can become corroded and deteriorate to the point that they are no longer effective and no longer adequately supporting the steel structure. As such, a need has developed so as to provide an underpinning pile assembly in which any steel components are effectively positioned so as to minimize exposure to moisture and oxygen.

Steel underpinning pile systems are often affixed to the foundation and driven at an angle into to the earth in a location below the foundation. This can create a great deal of torque onto the beam of the foundation and onto the steel pier. As such, a need has developed so as to provide an underpinning pile assembly which avoids the affects of the torquing of the beam and the steel pier.

It is an object of the present invention to provide an underpinning pile assembly which assures alignment of the various steel pipe segments and concrete pile segments.

It is another object of the present invention to provide an underpinning pile assembly that holds the pile assembly together when the pile assembly is installed into the earth.

It is another object of the present invention to provide an underpinning pile assembly that allows the installer to verify the depth of installation.

It is a further object of the present invention to provide an underpinning pile assembly that is adaptable to all types of soil and rock formations.

It is still another object of the present invention to provide an underpinning pile assembly that facilitates the ability to install the pile assembly upon and into limestone formations.

It is still a further object of the present invention to provide an underpinning pile assembly which is easy to install, and relatively inexpensive.

These and other objects and advantages of the present invention will become apparent from a reading of the attached specification and appended claims.

BRIEF SUMMARY OF THE INVENTION

The present invention is an underpinning pile assembly for supporting a structure upon the earth. This underpinning pile assembly comprises at least one steel pipe having an interior passageway, at least one concrete pile segment positioned above the steel pipe, and a cable extending through the interior passageway of the steel pipe and through the interior passageway of the concrete pile segment.

In the present invention, the steel pipe includes a plurality of steel pipes extending in end-to-end relationship in generally vertical alignment. One of the plurality of steel pipes is a lowermost pipe. The cable has an end affixed within the interior passageway of the lowermost pipe. Specifically, the lowermost pipe has an interior wall. A locking assembly is connected to the cable. This locking assembly is affixed within one of the plurality of steel pipes.

In the present invention, the locking assembly comprises a collar having an outer surface affixed to the interior wall of the lowermost pipe. The cable is affixed within an interior of the collar. The locking assembly further includes a pair of wedges positioned in interference-fit relationship between the cable and a wall of the interior of the collar. The collar is welded to the interior wall of the lowermost pipe. The pair of wedges are affixed to an outer surface of the cable at an end of the cable.

In the present invention, at least one of the plurality of steel pipes has an upset formed at one end thereof. This upset is positioned into an interior at and end of an adjacent pipe of the plurality of pipes.

The present invention is also a process for installing piles for supporting a structure upon the earth. This process includes the steps of: (1) affixing a cable to a steel pipe such that the cable extends therefrom; (2) driving the steel pipe into the earth for a desired distance from the structure; and (3) threading at least one concrete pile segment along the cable such that the concrete pile segment resides above the steel pipe.

In the process of the present invention, the steel pipe includes a plurality of steel pipes arranged in stacked relation in a generally vertical orientation. The step of affixing the cable includes locking an end of the cable within the interior passageway of a lowermost pipe of the plurality of steel pipes. The cable extends through the interior passageway of the plurality of steel pipes.

In the step of driving, a plurality of pipes are driven into the earth for a desired distance from the structure such that the interior passageways thereof are aligned.

The step of affixing includes affixing a collar to a wall of one of the plurality of steel pipes. The collar has an interior passageway. A cable is attached within the interior passageway of the cable. The cable extends through the interior passageway of the collar. At least one wedge is applied against an outer surface of the cable. The wedge is interposed between a wall of the interior passageway of the collar and the outer surface of the cable.

The process of the present invention further includes the step of forming an upset at an end of at least one of the plurality of steel pipes. This upset has an outer diameter that is different than an outer diameter of an end of another of the plurality of steel pipes. The step of driving comprises driving one of the plurality of steel pipes into the earth for a desired distance from the structure such that the steel pipe has an upper end. The upset of another of the plurality of steel pipes is engaged with the upper end of another steel pipe. The steel pipes is then driven into the earth for another distance from the structure.

The step of threading at least one concrete pile segment includes threading a plurality of concrete pile segments along the cable such that the plurality of concrete pile segments reside in end-to-end relationship in a generally vertical orientation. A pile cap is placed upon an uppermost concrete pile segment of the plurality of concrete pile segments.

DETAILED DESCRIPTION OF THE INVENTION

Figure 1:
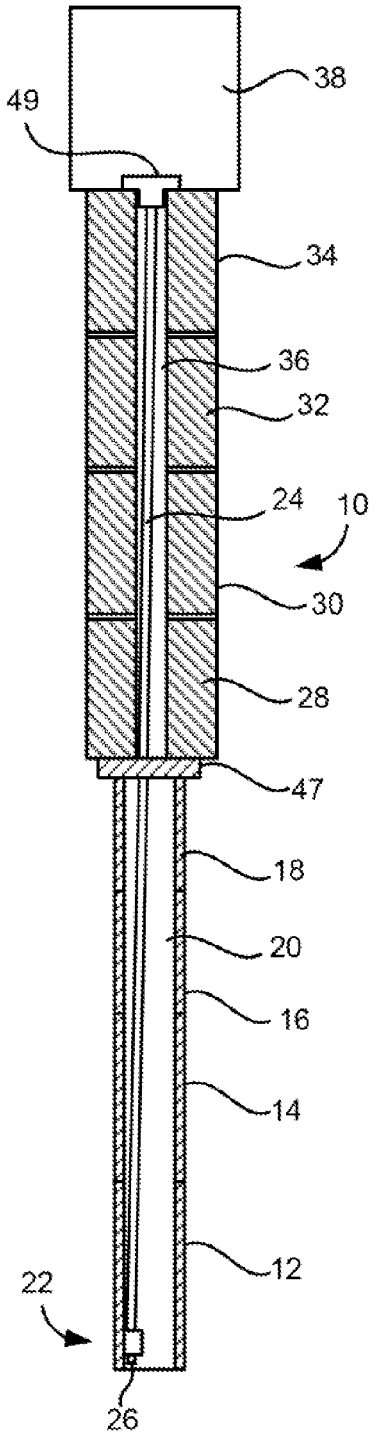
FIG. 1 is a cross-sectional view showing the underpinning pile assembly in accordance with the preferred embodiment of the present invention.

Referring to FIG. 1, there is shown the underpinning pile assembly 10 in accordance with the teachings of the present invention. The underpinning pile assembly 10 has a plurality of steel pipes 12, 14, 16 and 18 arranged in end-to-end stacked relationship to each other. Each of the steel pipes 12, 14, 16 and 18 has an interior passageway 20 extending therethrough. It can be seen that the lowermost pipe segment 12 has a collar 22 affixed to a wall of said interior passageway 20. The collar 22 is provided so as to that a cable 24 can have its end 26 affixed within the interior passageway 20 of the lowermost steel pipe 12.

In FIG. 1, there is a plurality of concrete pile segments 28, 30, 32 and 34 arranged in an end-to-end stacked relationship. The plurality of concrete pile segments 28, 30, 32 and 34 has an interior passageway 36 extending therethrough. Generally, the interior passageway 36 of the plurality of concrete pile segments 28, 30, 32 and 34 is axially aligned with the interior passageway 20 of the steel pipes 12, 14, 16 and 18. A pile cap 38 is positioned on the uppermost pile segment 34.

The cable 24 extends through the interior passageway 36 of the plurality of concrete pile segments 28, 30, 32 and 34 and through the interior passageway 20 of the steel pipes 12, 14, 16 and 18. The cable 24 will have an end 26 residing within the interior passageway 20 of the lowermost steel pipe 12. The collar 22 is secured to the end 26 of the cable 24 and generally abuts the interior wall of the lowermost steel pipe 12. As such, the cable 24 will be fixed within the interior passageways 20 and 36.

In the process of the present invention, the collar 22 is affixed against the inner wall of the lowermost steel pipe 12. The collar 22 can be affixed by welding to this inner wall. The end 26 of the cable 24 can then be secured within the interior of the collar 22 so that the end 26 of the cable 24 is in a fixed position within the interior of the lowermost steel pipe 12. The steel pipe 12 can then be driven into the earth a desired distance from a structure that is support by the pile cap 38.

Figure 3:
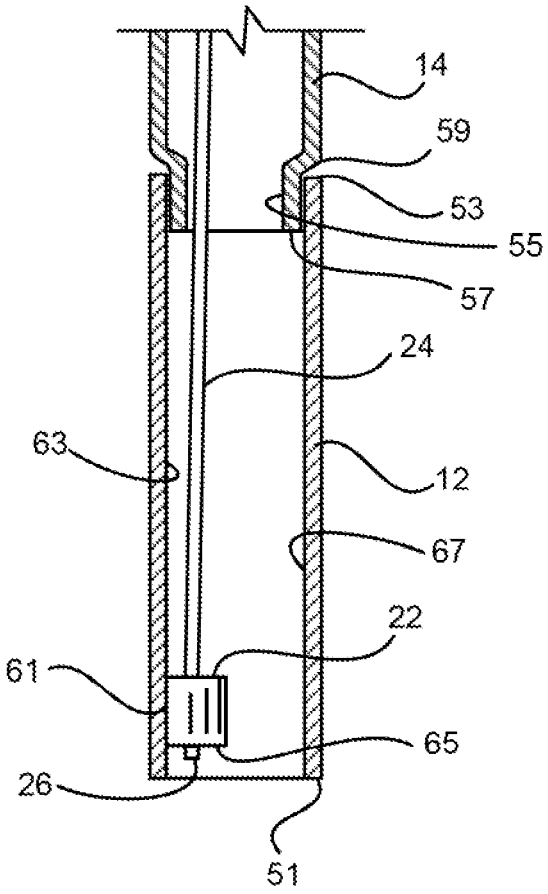
FIG. 3 is a cross-sectional side elevational view showing the locking of the cable within the lowermost steel pipe.

As will be described hereinafter, the steel pipes 12, 14, 16 and 18 can be locked one upon each other through the use of engaging upsets. In other words, an end of one pipe is received within an interior of another pipe so as to have a shoulder abutting the end of the pipe. As such, a proper driving of consecutive steel pipes can be achieved. FIG. 3 shows, in particular, this configuration of an upset.

In the process of the present invention, the steel pipes 12, 14, 16 and 18 are consecutively driven into the earth for a desired distance from the structure supported by the pile cap 38. The cable 24 is affixed to the lowermost steel pipe 12 so that it extends therefrom and through the interior passageway of the plurality of steel pipes 12, 14, 16 and 18. A transition member 47 is threaded along the cable 24 and positioned so as to reside against the top of the uppermost steel pipe 18. The concrete piles 28, 30, 32 and 34 are consecutively threaded along the cable 24 such that the lowermost pile segment 28 will reside on a top of the transition member 47.

As can be seen in FIG. 1, the concrete pile segments 28, 30, 32 and 34 have a diameter that is approximately twice the diameter of the steel pipes 12, 14, 16 and 18. An anchor 49 is affixed to the cable 28 at the uppermost concrete pile segment 34. As such, the anchor 49 secures the cable 24 in a proper position through the interior passageways 20 and 36 in a generally vertical orientation.

The pile cap 38 is suitably threaded along the cable 24 so as to reside in a position above the uppermost concrete pile segment 34.

In the present invention, the cable 24 assures the alignment of the steel pipes 12, 14, 16 and 18, along with the alignment of the concrete pile segments 28, 30, 32 and 34. The cable functions to hold the piling together. One can easily determine the length of the cable within the interior passageways 20 and 36 and the approximate depth of the piling. Since the steel pipes 12, 14, 16 and 18 are very strong and sturdy, they can be applied to various types of soil. Additionally, the strong steel pipes 12, 14, 16 and 18 allow the underpinning pile assembly 10 to be driven into limestone formations.

Typically, during the installation of the steel pipes 12, 14, 16 and 18, water is injected through the interior passageway 20 so as to wash away any soil that might reside therein. As such, the collar 22 is affixed to an inner wall of the lowermost steel pipe 12 so as to define a space with another side of the lowermost steel pipe 12. As such, a clear path is provided whereby water can be injected outwardly of the bottom end of the lowermost steel pipe 12. Typically, the steel pipes 12, 14, 16 and 18 will be driven into the earth until a stable soil is reached. At that time, the concrete pile segments 28, 30, 32 and 34 can be utilized.

Within the concept of the present invention, any number of steel pipes can be utilized for the support of the concrete pile segments. Additionally, any number of concrete pile segments can be applied. As such, the illustration of four steel pipes and four concrete pile segments is merely illustrative of the preferred embodiment of the present invention and should not be construed, in any way, as limiting of the present invention. Although various types of locking assemblies can be utilized so as to secure the end 26 of the cable 24 within the lowermost steel pipe, the preferred embodiment of the present invention utilizes a collar 22 with wedges therein so as to fix the end 26 within the interior of the collar 22. It is possible, within the concept of the present invention, that various types of locking assemblies can also be used so as to properly secure the cable 24 in its desired position. Additionally, it is possible, within the concept of the present invention, that the end 26 of the cable 24 could also be applied within steel pipes that are above the lowermost pipe segment.

Figure 2:
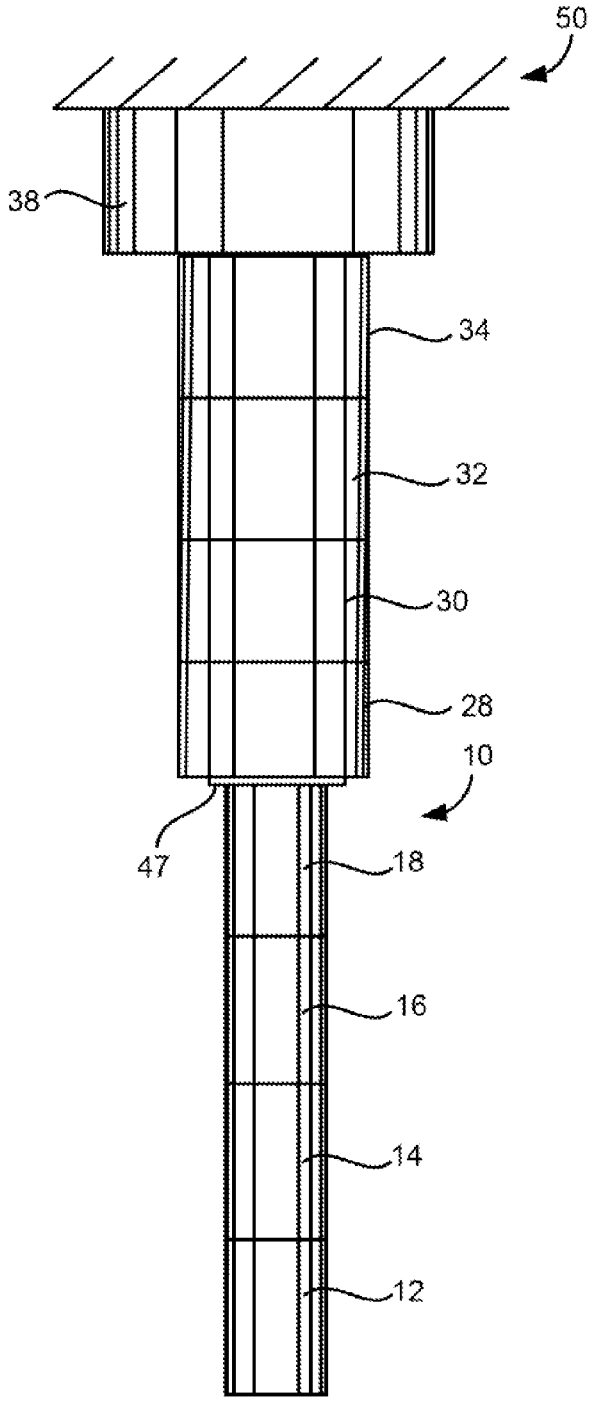
FIG. 2 is a side elevational view showing the underpinning pile assembly of the present invention as used for supporting a structure thereon.

FIG. 2 is a side elevational view of the underpinning pile assembly 10 of the present invention. It can be seen that the steel pipes 12, 14, 16 and 18 are arranged in a stacked configuration. Each of the pipes 12, 14, 16 and 18 has an annular configuration. The transition member 47 is positioned at top of the uppermost steel pipe 18. Similarly, the concrete pile segments 28, 30, 32 and 34 are annular members that extend upwardly from the top of the transition member 47. The pile cap 38 serves to support the structure 50 thereon. The cable 44 will extend through the interiors of the steel pipes and the concrete pile segments.

FIG. 3 is a detailed view showing the configuration of the locking assembly of the present invention and the configuration of the connection of adjacent steel pipes. In particular, it can be seen that the lowermost steel pipe 12 has a generally constant diameter between the end 51 and the end 53. The steel pipe segment 14 is illustrated as having an upset 55 formed at end 57 thereof. The upset 55 will define a segment that has an outer diameter that is less than the inner diameter of the lowermost steel pipe 12. A shoulder 59 will be defined between the upset 55 and the remainder of the steel pipe segment 14. The shoulder 59 will reside against the end 53 of the lowermost steel pipe segment 12.

As a result of the configuration of the upset 55, the first steel pipe segment 12 can be driven a desired distance into the earth. The steel pipe segment 14 can have its ends 57 inserted into the end 53 of the pipe segment 12. As such, a secure fit is achieved between the steel pipe segments 12 and 14. A driving force applied upon the steel pipe 14 will cause a corresponding movement of the pile segment 12 by virtue of the forces applied from the shoulder 59 of the steel pipe 14 and the end 53 of the steel pipe 12. This arrangement also assures that the steel pipe 14 will be in a straight vertical alignment with the steel pipe 12.

Within the concept of the present invention, it is possible that the upset 55 could have an inner diameter that is greater than an outer diameter of the steel pipe 12. As such, the steel pipe 14 would be applied over the outer diameter of the steel pipe 14. There would be an inner shoulder that would abut the end 53 of the steel pipe 12.

In FIG. 3, it can be seen that the collar 22 has a surface 61 that is affixed to the side 63 of the inner wall of the steel pipe 12. The collar 22 has a generally cylindrical configuration with an interior passageway. The cable 22 extends through the interior passageway of the collar 22 so as to have end 26 extending outwardly therefrom. The bottom 65 of the collar 22 is in spaced relationship inwardly from the end 51 of the steel pipe 12. The cable 22 will then extend upwardly, and generally vertically, through the interiors of the steel pipes 12 and 14.

It can be seen in FIG. 3 that the opposite side 67 of the inner wall of the steel pipe 12 is in spaced relationship from the outer diameter of the collar 22. As such, proper water injection can be applied through the interior of the steel pipes 12 and 14 and outwardly of the end 51 through the space defined between the collar 22 and this side 67. As such, the application of the collar 22 will not interfere with the proper installation of the steel pipes 12 and 14 into the earth.

Figure 4:
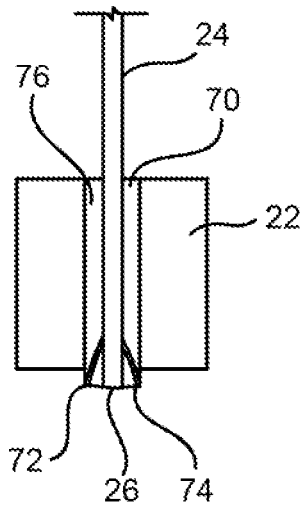
FIG. 4 is a cross-sectional side elevational view showing the locking assembly of the present invention.

FIG. 4 shows a cross-sectional view illustrating how the cable 24 is affixed within the interior passageway 70 of the collar 22. In particular, a pair of wedges 72 and 74 are affixed around the end 26 of the cable 24. The wedges 72 and 74 will be inserted into the interior passageway 70 so as to wedge against the inner wall 76 of the interior passageway 70. As such, a strong interference-fit relationship is established between the wedges 72 and 74 and the outer surface of the cable 24 and the inner wall 76 of the interior passageway 70 of the collar 22. As a result, the end 26 of the cable 24 is strongly fixed in position. The wedges 72 and 74 are conventional wedges that are often utilized in association with anchors of post-tension construction.

Figure 5:
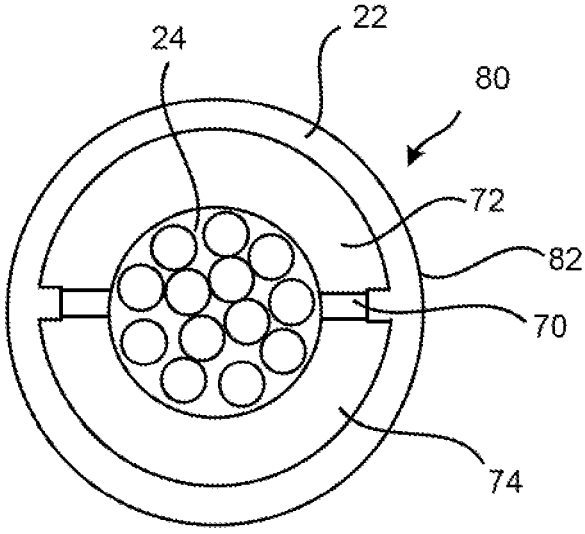
FIG. 5 is an end view showing the locking assembly of the present invention.

FIG. 5 illustrates an end view of the locking assembly 80 of the present invention. In particular, the locking assembly 80 includes collar 22 having an outer surface 82. In FIG. 5, there is the first wedge 72 and the second wedge 74 that is received within the interior passageway 70 of the collar 22. The cable 24 is affixed against the inner wall of each of the wedges 72 and 74. As such, the wedges 72 and 74 generally surround the cable 24 so as to achieve a secure engagement therewith. The angled surfaces of the wedges 72 and 74 will be engaged within the wall 76 of the interior passageway 70 of the collar 22 so as to fix the cable 24 in its desired position.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An underpinning pile assembly for supporting a structure upon a ground comprising:

a plurality of steel pipes each having an interior passageway, said plurality of steel pipes extending in end-to-end relationship in generally vertical alignment, one of said plurality of steel pipes being a lowermost pipe, said lowermost pipe having an interior wall;

at least one concrete pile segment positioned above the plurality of steel pipes, the concrete pile segment having an interior passageway;

a cable extending through said interior passageway of the plurality of steel pipes and through said interior passageway of the concrete pile segment, said cable having an end affixed within said interior passageway of said lowermost pipe; and a locking assembly connected to said cable, said locking assembly affixed within one of said plurality of steel pipes, said locking assembly comprising:

a collar having an outer surface affixed to said interior wall of said lowermost pipe, said cable being affixed within an interior of said collar; and a pair of wedges positioned in interference fit relation between said cable and a wall of said interior of said collar.

2. The underpinning pile assembly of claim 1, said collar being welded to said interior wall of said lowermost pipe, said pair of wedges being affixed to an outer surface of said cable at an end of said cable.

3. The underpinning pile assembly of claim 1, at least one of said plurality of steel pipes having an upset formed at one end thereof, said upset being positioned into an interior at and end of an adjacent pipe of said plurality of pipes.

4. An underpinning pile assembly for supporting a structure upon a ground, the underpinning pile assembly comprising:

a plurality of steel pipes each having an interior passageway, said plurality of steel pipes extending in end-to-end relationship in generally vertical alignment, one of said plurality of steel pipes being a lowermost pipe, said lowermost pipe having an interior wall;

at least one concrete pile segment positioned above the plurality of steel pipes, the concrete pile segment having an interior passageway;

a cable extending through said interior passageway of the plurality of steel pipes and through said interior passageway of the concrete pile segment, said cable having an end affixed within the interior passageway of said lowermost pipe; and a locking assembly connected to said cable, said locking assembly affixed within at least one of said plurality of steel pipes, said locking assembly comprising:

a collar affixed to an interior wall of one of said plurality of steel pipes, said collar having an interior passageway; and a wedge affixed to said cable, said wedge being engaged with a wall of said interior passageway of said collar.

5. The underpinning pile assembly of claim 4, said wedge comprising a pair of wedges positioned around at least a portion of a diameter of said cable.

6. The underpinning pile assembly of claim 4, said lowermost pipe having a bottom end, said collar affixed to a wall of said lowermost pipe of said bottom end.

7. A process for installing pipes for supporting a structure upon a ground, the process comprising:

affixing a cable to at least one steel pipe of a plurality of steel pipes arranged in stacked relation in generally vertical orientation, the step of affixing comprising:

locking an end of said cable within an interior passageway of a lowermost pipe of said plurality of steel pipes, said cable extending through interior passageway of said plurality of steel pipes, the step of locking comprising:

affixing a collar to a wall of one of said plurality of steel pipes, said collar having an interior passageway; and attaching said cable within said interior passageway of said collar, the step of attaching comprising:

extending said cable through said interior passageway of said collar;

applying at least one wedge against an outer surface of the cable; and interposing the wedge between a wall of said interior passageway of said collar and said outer surface of said cable; and driving the plurality of steel pipes into the earth for a desired distance from the structure; and threading at least one concrete pile segment along said cable such that the concrete pile segment resides above the plurality of steel pipes.

8. The process of claim 7, the step of driving comprising:

driving said plurality of steel pipes into the earth for the desired distance from the structure such that the interior passageways thereof are aligned.

9. The process of claim 7, further comprising:

forming an upset at an end of at least one of said plurality of steel pipes, said upset having an outer diameter different than an outer diameter of an end of another of said plurality of steel pipes.

10. The process of claim 9, said step of driving comprising:

driving one of said plurality of steel pipes into the earth for a desired distance from the structure such that the steel pipe has an upper end;

engaging said upset of another of said plurality of steel pipes with said upper end of said one of said plurality of steel pipes; and driving said another of said plurality of steel pipes into the earth for another desired distance from the structure.

11. The process of claim 7, the step of threading at least one concrete pile segment comprising:

threading a plurality of concrete pile segments along said cable such that said plurality of concrete pile segments reside in end-to-end relationship in a generally vertical orientation; and placing a pile cap upon an uppermost concrete pile segment of said plurality of concrete pile segments.

* * * * *